United States Patent [19]

Hug

[11] 4,276,070

[45] Jun. 30, 1981

[54] REMOVABLE DUST COLLECTING CONTAINER FOR PROFESSIONAL AND HOUSEHOLD VACUUM CLEANERS

[75] Inventor: Niklaus Hug, Romanshorn, Switzerland

[73] Assignee: Rommag P. Wörwag & Co., Romanshorn, Switzerland

[21] Appl. No.: 106,481

[22] Filed: Dec. 26, 1979

[30] Foreign Application Priority Data

Dec. 23, 1978 [DE] Fed. Rep. of Germany ..... 2856103

[51] Int. Cl.[3] ..... B01D 46/04

[52] U.S. Cl. ..... 55/429; 15/352; 55/472; 55/486; 55/502

[58] Field of Search ..... 55/482, 486–488, 55/502, 494, 429, 512, 518, 504, 467, 470, 471–473, 373, 378, 372; 15/352

[56] References Cited

U.S. PATENT DOCUMENTS

| | | | |
|---|---|---|---|
| 2,386,532 | 10/1945 | Wolcott | 210/477 |
| 2,713,946 | 7/1955 | Abrams | 210/451 |
| 3,365,864 | 1/1968 | Iizima | 55/487 |
| 3,856,488 | 12/1974 | Kato et al. | 15/327 E |
| 4,132,641 | 1/1979 | Elsworth | 210/443 |

FOREIGN PATENT DOCUMENTS

| | | | |
|---|---|---|---|
| 1436403 | 5/1976 | United Kingdom | 55/487 |

OTHER PUBLICATIONS

Absolute Filter—Cambridge Filter Corp. Bulletin 19A Syracuse, N. Y., pp. 1–4.

*Primary Examiner*—Bernard Nozick
*Attorney, Agent, or Firm*—Becker & Becker, Inc.

[57] ABSTRACT

A removable dust collecting container for professional and household vacuum cleaners. The container is closed with a dust filter embodied as a cover, whereby between the dust collecting container and the cover-like filter, a soft-elastic seal is arranged. The filter is embodied in a frame configuration, and projects in a positively connecting manner into the opening of the dust collecting container. The seal is arranged tangentially between the inner surface of the dust collecting container and the outer surface of the filter which projects or extends into the dust collecting container. The filter may be embodied as a double filter, including a coarse filter on the inlet side and an immediately subsequent filter embodied as a fine filter.

9 Claims, 2 Drawing Figures

REMOVABLE DUST COLLECTING CONTAINER FOR PROFESSIONAL AND HOUSEHOLD VACUUM CLEANERS

The present invention relates to a removable dust collecting container for professional and household vacuum cleaners. The container is closed with a dust filter embodied as a cover having a soft-elastic seal arranged between the dust collecting container and the cover-like filter.

BACKGROUND OF THE INVENTION

Both professional and household vacuum cleaners are known which have a removable dust collecting container. With these known vacuum cleaners, the seal between the dust collecting container and the filter or the other housing parts cooperating therewith is effected by utilizing a sealing element which is located between the individual stacked sequentially arranged structural elements. Since the vacuum cleaners can have considerable dimensions, and accordingly the cross sections to be sealed off with respect to each other are correspondingly large, the surfaces stacked one upon the other or engaging each other must be produced and finished with a corresponding accuracy expenditure in order to avoid having the surfaces, which are to be sealed with respect to each other, provided with any divergences in size or divergences which are too great in departing from the planar parallel relationship of the surfaces to be sealed with respect to each other, so that lack of a tight seal can be avoided.

Special holding and clamping elements are necessary for pressing together the parts to be sealed with respect to each other in connection with a soft elastic sealing element located therebetween and for attaining the necessary sealing effect.

FIELD OF THE INVENTION

It is an object of the present invention to provide a reliable seal, without utilization of additional holding or clamping elements, between the dust collecting container and the filter, and furthermore to embody the filter in such a manner that an optimum cleaning is made possible with a long durability of the filter.

These objects, and other objects and advantages of the present invention, will appear more clearly from the following specification in connection with the accompanying drawings, in which:

SUMMARY OF THE INVENTION

The dust collecting container of the present invention is characterized primarily in that the filter is embodied in a frame-like manner and projects in a positively connecting manner into the opening of the dust collecting container. The seal is arranged tangentially between the inner surface of the dust collecting container and the outer surface of the filter which projects or extends into the dust collecting container. The seal may be journalled or placed in a groove of the filter. The upper region of the dust collecting container is conically widened to the length of the insertion or projection depth of the filter. The end face of the frame-like filter surrounding the same extends at a slight distance from and parallel to the inner surface of the conically widened dust collecting container. The filter has a narrow edge surrounding or encircling the same and extending horizontally; the filter engages, with the narrow edge, upon the upper horizontal boundary surface of the dust collecting container. The filter may be embodied as a double filter, whereby the inlet side is made as a coarse filter, and the immediately subsequent filter is made as a fine filter. The coarse filter provides a structure which enlarges the filter surface. The coarse filter may be made as a folded flat filter. The fine filter partially or completely fills out the volume of the filter frame. The fine filter may be made as a single or multiple layer combination of differing materials. The fine filter may comprise paper and/or fleece, textile material, open-pore foam material, or a sintered material.

The tangentially arranged seal, which in itself is immovably held in the groove of the filter, sealingly engages the inner wall of the dust collecting container during installation or placement of the filter, embodied as a cover, upon the dust collecting container. Consequently, a simple and quick manner of producing the necessary seal is brought about. The embodiment of the filter as a double filter, and the attainable enlargement of the individual filter surfaces or filter volumes, contributes to the improvement of the cleaning and the service life of the filter.

DETAILED DESCRIPTION

Figure 1:
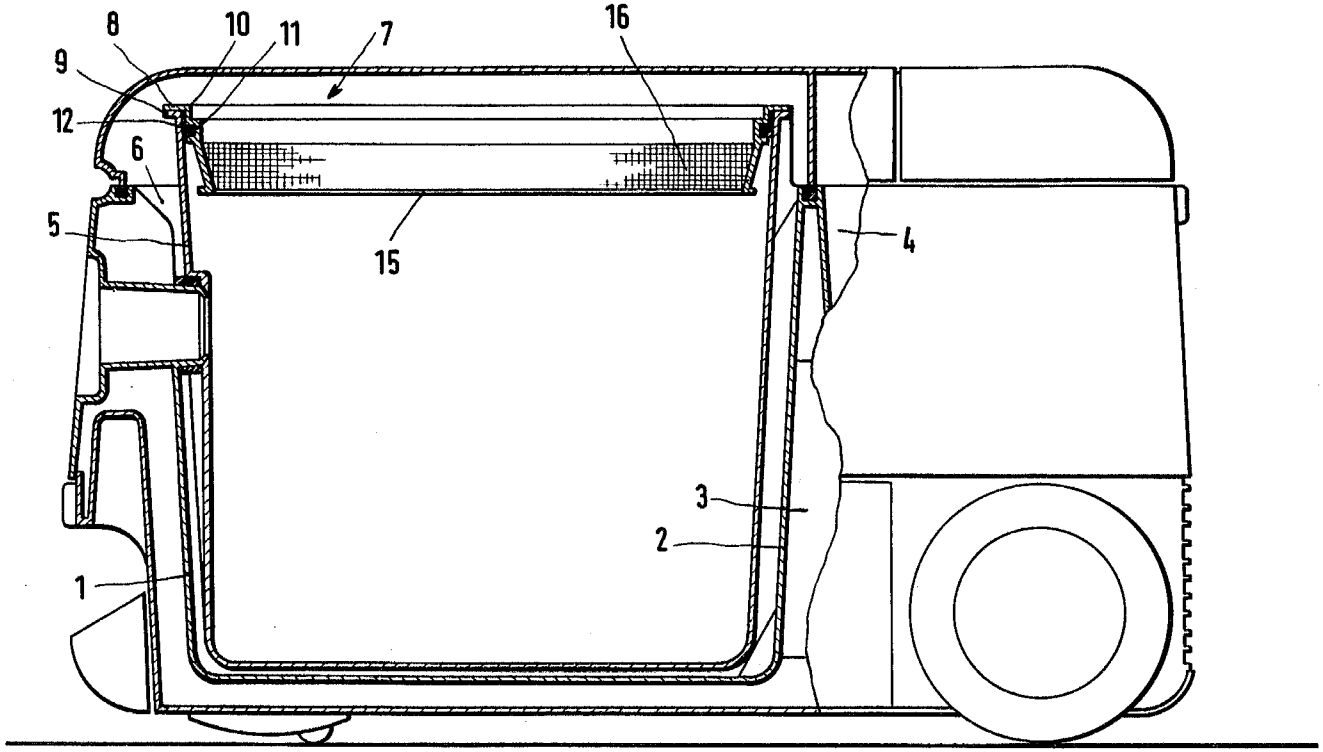
FIG. 1 is a partial longitudinal section of the vacuum cleaner of the present invention.
Figure 2:
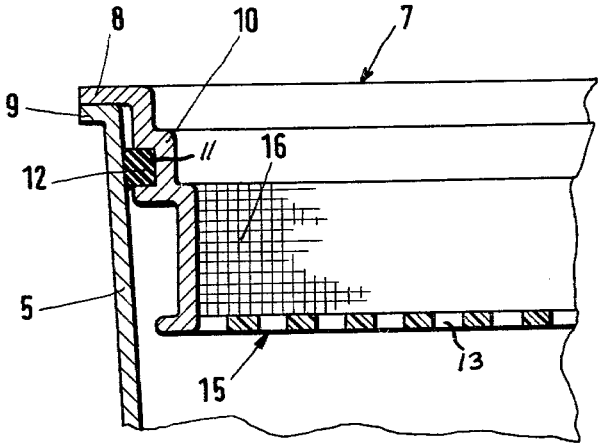
FIG. 2 is an enlarged illustration of the seal between the filter and the dust collecting container.

Referring now to the drawings in detail, the pan-shaped vacuum cleaner housing 1 is subdivided by a transverse wall 2 into a smaller chamber 4 which receives the motor blower 3, and a larger chamber 6, which receives the dust collecting container 5. The dust collecting container 5, which is open at its upper end, is covered with a filter 7 embodied as a cover. The filter 7 is embodied in a frame-form, and has a narrow edge 8 extending horizontally around the filter. The edge 8 of the filter 7 engages upon the upper horizontal boundary surface 9 of the dust collecting container 5. The filter 7 has a vertical part 10 which, in a groove 11, contains the soft-elastic sealing element 12. The vertical part 10 of the filter 7 projects in a positively connecting manner into the slightly conically widened or expanded region of the dust collecting container 5. The frame-like filter 7, in this connection, is dimensioned in such a way that the vertical part 10, with a nominal spacing, extends parallel to the inner surface of the slightly conically widened part of the dust collecting container 5, and the soft-elastic sealing element 12, which is in the groove 11 of the vertical frame part 10, engages sealingly against the inner wall of the dust collecting container 5.

The filter 7, embodied as a cover part, is preferably built up as a double filter. That portion of the filter 7 subjected to the direct inlet flow of the dust-containing air is embodied as a coarse filter 15. The heavier parts of the dust-air flow streaming through the inlet 13 fall or precipitate from the air flow and drop to the bottom surface of the dust collecting container 5. The lighter particles are blown against the underside of the coarse filter 15 by the upwardly discharging air flow, and are here separated from the air flow or stream. After the vacuum cleaner has been turned off, these lighter particles fall from the underside of the coarse filter 15 to the bottom of the dust collecting container 5. The fine dust passing through the coarse filter 15 is held back in the fine filter 17 of the filter 7. The fine filter 16 has a large volume, so that a long durability or service life of the filter 7 is assured. The fine filter 16 can be made of paper, fleece, or texile material and can be made as a single or multi-layer arrangement, and in different combinations, or the filter 16 can consist of a soft or hard open pore foam material, or it can consist of sintered material.

The flat filter, embodied as the coarse filter 15, can also be embodied as a folded filter, or it can have any suitable form which brings about an enlargement of the filter surface.

The present invention is, of course, in no way restricted to the specific disclosure of the specification and drawings, but also encompasses any modifications within the scope of the appended claims.

What I claim is:

1. A removable dust collecting container for professional, industrial, and household vacuum cleaner, said container having an open top portion when set upright, and an inlet for dusty gas, said container comprising in combination:

a frame-like dust filter serving as a cover for closing off said open portion of said dust collecting container by being arranged in said container in a positive connection; said top portion of said dust collecting container being conically widened to receive said filter, said filter including a frame being provided with a narrow peripheral edge that extends horizontally, and said dust collecting container being provided with an upper boundary surface that extends horizontally and upon which said narrow edge of said filter frame engages; and a soft-elastic seal rectangular in cross section and sealingly arranged in engagement between the inner surface of said dust collecting container and the outer surface of said filter frame, when the latter is arranged in said container, for effecting said positive connection.

2. A container in combination according to claim 1, in which the peripheral surface of said filter frame extends a slight distance from and substantially parallel to the inner surface of said dust collecting container.

3. A container in combination according to claim 1, in which said filter frame is provided with a groove for receiving said seal positively therein.

4. A container in combination according to claim 1, in which said filter includes a double filter, including a coarse filter on the inlet side of said filter, and an immediately following fine filter.

5. A container in combination according to claim 4, in which said coarse filter has a structure adapted to enlarge the filter surface.

6. A container in combination according to claim 5, in which said coarse filter is a folded flat filter.

7. A container in combination according to claim 4, in which said fine filter at least partially fills out said filter frame.

8. A container in combination according to claim 7, in which said fine filter is an at least single layer combination of differing materials.

9. A container in combination according to claim 8, in which said fine filter comprises at least one of the group consisting of paper, fleece, textile material, open-pore foam material, and sintered material.

* * * * *